United States Patent [19]

Rettich et al.

[11] Patent Number: 4,513,464

[45] Date of Patent: Apr. 30, 1985

[54] METHOD FOR CONTROLLING THE ACCELERATION OF A CENTRIFUGING DEVICE

[75] Inventors: Jakob Rettich, Zürich; Leonhard Spiewok, Wallisellen, both of Switzerland

[73] Assignee: Sulzer-Escher Wyss Ltd., Zürich, Switzerland

[21] Appl. No.: 554,454

[22] Filed: Nov. 22, 1983

[30] Foreign Application Priority Data

Dec. 14, 1982 [CH] Switzerland ..... 7261/82

[51] Int. Cl.[3] ..... D06F 33/02

[52] U.S. Cl. ..... 8/159; 68/12 R; 68/23.1; 68/24

[58] Field of Search ..... 8/158, 159; 68/12 R, 68/23.1, 24; 210/144; 494/7, 82; 74/573 R

[56] References Cited

U.S. PATENT DOCUMENTS

| | | | |
|---|---|---|---|
| 3,226,960 | 1/1966 | Mellinger | 68/24 |
| 3,322,278 | 5/1967 | Ishoy et al. | 68/23.1 X |
| 3,583,182 | 6/1971 | Matsuura | 68/23.1 |
| 4,113,325 | 9/1978 | Miller | 308/5 R |

FOREIGN PATENT DOCUMENTS

| | | | |
|---|---|---|---|
| 2915815 | 11/1980 | Fed. Rep. of Germany . | |
| 3039315 | 5/1982 | Fed. Rep. of Germany . | |
| 3117106 | 11/1982 | Fed. Rep. of Germany | 68/23.1 |
| 952039 | 3/1964 | United Kingdom | 68/23.1 |

*Primary Examiner*—Philip R. Coe

*Attorney, Agent, or Firm*—Robert A. Ostmann

[57] ABSTRACT

The invention relates to centrifuging devices, and particularly to the acceleration thereof to a design speed. In order to prevent imbalance (U) of the device exceeding a permitted maximum value ($U_m$) during acceleration, the imbalance (U) is monitored and acceleration ($\alpha$) controlled as a function of temporal changes in the imbalance (U). Acceleration $n/_t$ may be controlled in relation to the difference ($\Delta U$) between the measured imbalance (U) and the maximum value ($U_m$), in relation to the rate of change ($\beta$) of the measured imbalance, or to maintain the imbalance (U) between upper ($U_1$) and lower ($U_2$) threshold values at or below the maximum value ($U_m$). Acceleration to the design speed can thus be accomplished with minimum delay and variation with reference to operating criteria of the device.

9 Claims, 3 Drawing Figures

METHOD FOR CONTROLLING THE ACCELERATION OF A CENTRIFUGING DEVICE

BACKGROUND TO THE INVENTION

The invention relates to centrifuging devices and to a method for controlling the acceleration thereof to a particular operating speed to prevent imbalance of the device exceeding a predetermined maximum. This is accomplished by controlling the temporal alteration of the rotational speed as the maximum permissible imbalance is approached.

In the acceleration of centrifuging devices, such as centrifuges or washing machines, imbalances frequently occur, which impose potentially unacceptable loads on the device, in particular its bearings. This is of particular significance in the case of centrifuging devices with a horizontal axis of rotation, for example the drums in washing or spinning machines, particularly those with large capacities. In such devices, on acceleration the product; e.g., the pieces of washing, is lifted by the rotating centrifuge drum, but detaches itself before the apex from the drum wall and falls in a free trajectory into the lower part of the drum. When the rotational speed is increased so much that the centrifugal force exceeds the gravitational force, the free trajectory disappears and the washing rests against the inner side of the drum. Depending on the distribution of the product; i.e., the washing, a certain imbalance results, which cannot be avoided even by careful packing of the product into the centrifuging device. In practice it is therefore necessary to limit the imbalance occurring on rotation of the centrifuging device at the final operation rotational speed to a permissible level.

According to German Patent Specification Nos: 29 15 815 or 30 39 315 in a centrifuging process the rotational speed is only increased to one at which the maximum permissible imbalance is reached. The dewatering capacity is thus limited. In German Patent Specification Nos: 22 04 325 or 29 39 340 it is proposed to measure the imbalances occurring in washing or centrifuging machines, and stop the device when the imbalance on acceleration exceeds a certain value, and subsequently to undertake one or more acceleration attempts until the design rotational speed is reached without the permissible imbalance being exceeded. However, such a method is time-consuming, and inefficient and expensive in terms of energy.

Reference is also directed to copending U.S. application Ser. No. 435,033, filed 10-18-82 in which it is proposed that, instead of switching off the centrifuging device when a particular imbalance threshold has been reached, simply to keep the rotational speed constant for a particular time. In so doing, utilization is made of the fact that the product, in particular the washing, begins to flow slowly and distributes itself more evenly over the inner wall of the drum. At the end of this pause period, in most cases the product has distributed itself so evenly that the acceleration process can be resumed without danger. Only if it is established that the imbalance has not been significantly or sufficiently reduced does the centrifuging device have to be switched off.

This technique results in a certain improvement in efficiency, but we have found that greater savings on time and energy can be achieved.

SUMMARY OF THE INVENTION

The present invention seeks to further improve on the techniques described above, and in particular to create a method in which the acceleration time of a centrifuging device up to the operating or design speed of rotation is reduced together with required energy consumption, while ensuring that a pre-set highest permissible imbalance on acceleration is safely and reliably avoided. According to the invention, the imbalance of the device is monitored and the acceleration controlled as a function of temporal changes in the measured imbalance. Control may be effected in relation to the difference between the measured imbalance and the permitted maximum value; in relation to the rate of change of the measured imbalance; or to maintain the imbalance between upper and lower threshold values at or below the maximum value. Since a temporal imbalance alteration serves as the control criterium, and not an absolute value of same, the acceleration time up to full rotational speed is shortened without the maximum permissible imbalance being exceeded, and a faster, less energy-consuming and more efficient dewatering in the centrifuging process is achieved.

In one embodiment of the invention, the control of rotational speed is carried out such that on the measured imbalance reaching an upper threshold value, the rotational speed is firstly kept at least approximately constant and a further increase in the rotational speed is made only after a time delay determined by the measured imbalance decreasing by a pre-set amount; i.e., falls to another, lower, threshold value. The cycle of interruption and further acceleration can be repeated several times until the design or operating speed is reached.

In another embodiment the difference of the measured imbalance from another imbalance value is measured and the speed of rotation regulated as a function of this differential value. For example, the differential between the measured imbalance and a fixed value, typically the maximum permissible imbalance, can be determined and the temporal alteration in the rate of rotation; i.e., the acceleration, can be made smaller, the closer the measured imbalance lies to the maximum permissible imbalance. Alternatively, the measured imbalance can be compared with the immediately preceding measurement of imbalance and consequently the rate of rise of the imbalance can be determined. The temporal alteration in rotation rate is then regulated such that the alteration is smaller; i.e., the acceleration takes place more slowly, the greater the temporal alteration in imbalance; i.e., the faster the imbalance rises per unit of time. The dependence of alteration in rotation rate and the development of imbalance can thus be selected such that an acceleration process, which is optimal in terms of expenditure of time and energy and is continuous, is made possible without idle time.

BRIEF DESCRIPTION OF THE DRAWING

Embodiments of the invention will now be described by way of example and with reference to the accompanying drawing which shows in each figure a graph of the temporal course of the rotational rate and the imbalance in an accelerating centrifuging device. In the drawing.

DESCRIPTION OF PREFERRED EMBODIMENTS

Each figure is a graph which plots against time t the path of the rotation rate n of the drum of a centrifuging device, and the imbalance U occurring on the drum on acceleration. Imbalance can be understood here to be the geometric displacement of the centre of gravity in the drum, or its product with the rotating mass or the oscillating force occurring on rotation as a result of the displacement of the centre of gravity. This may be measured for example with a suitable power sensor on the bearing of the centrifuging device whereby the variation signal is indicative of the imbalance and with a horizontal drum axis the equisignal for the mass; i.e., for the residual moisture of the washing. Expediently, particularly for large and heavy centrifuging devices a hydrostatic bearing with movable support pistons and dynamic characteristic property is used, as is described for example in U.S. Pat. No: 4,113,325. Here the imbalance force can be directly determined through a measurement of the deflection of the support piston. It may also be expedient to combine the measured imbalance with the rotational rate, which is also measured, by means of a suitable circuit arrangement or with a microprocessor, and to convert to the theoretical imbalance which is to be expected in operation with the operation rotation rate provided and to use the projected imbalance as standard amount.

Figure 1:
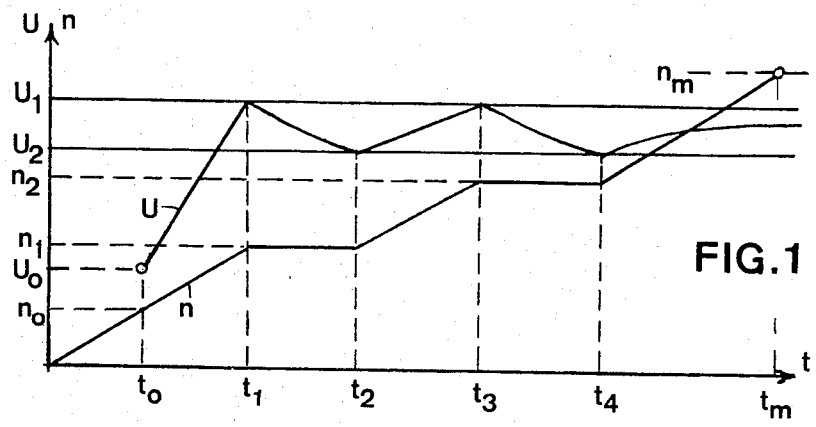
FIG. 1 illustrates a method with interrupted acceleration.

FIG. 1 shows an acceleration method for a centrifuging device, specifically a washing/centrifuging device with horizontal axis, in which rotation speed n first of all rises continuously. After a period of time $t_o$ a rotation speed $n_o$ and a centrifugal acceleration is reached, at which the product; i.e., the washing situated in the centrifuging drum, rests against the inner wall of the drum.

Now the regulating mechanism is switched on. The measured imbalance U or the standard level derived therefrom, lies in the example shown firstly below an upper threshold value $U_1$ and rises with increasing rotational speed n, until at the point of time $t_1$ and rotation speed $n_1$ it reaches the upper threshold value $U_1$. At this moment the alteration in the rotation speed n is at least approximately reset to O; i.e., the rotation speed is maintained constant, at least approximately, to the value $n_1$. A certain retrogression of the rotation speed or a slight increase can thereby be tolerated. If the measured imbalance already exceeds the upper threshold value $U_1$ at the point of time $t_o$; i.e., at the beginning of the regulation process, then already at this point of time the rotation speed is kept constant. During this phase, in which the rotation speed remains more or less unchanged, the product distribution in the centrifuge drum partially balances itself out through flow processes and the continuing dewatering of the centrifuged product, and the imbalance diminishes. At a point of time $t_2$ the imbalance has fallen by a certain amount $(U_1-U_2)$; i.e., has diminished to a lower threshold value $U_2$, and at this point of time the alteration in rotation speed n is again regulated to a positive value; i.e., the acceleration process continues with an increasing rotation speed. If during this second acceleration phase the upper threshold value $U_1$ is again reached, for example at a point of time $t_3$ and at a rotation speed $n_2$, then the cycle is repeated; i.e., the rotation rate is again kept constant, until the imbalance has fallen to the lower threshold value $U_2$, for example at the point of time $t_4$, whereupon the acceleration process is resumed up to operation rotation rate $n_m$.

It may be expedient to limit the number of the above cycles and to interrupt the acceleration process; i.e., to reduce the rotation speed to zero, if after a certain number of cycles the upper threshold value is still exceeded; i.e., no or insufficient compensation of imbalance has taken place. Alternatively, the rotation speed reached can be kept constant, if this speed has already reached a value where a sufficient centrifugal performance is to be expected. It may also be expedient to interrupt the acceleration process and to reduce the rotation rate to zero; i.e., start again, if the imbalance is not reduced or is only reduced to an insufficient extent after the upper imbalance threshold is exceeded and, thereby initiated, after the rotation rate is kept constant. Once the maximum or design rotation speed $n_m$ is reached, it is maintained until the residual moisture, indicated by the equisignal of the imbalance sensor, has fallen to a pre-set value.

Figure 2:
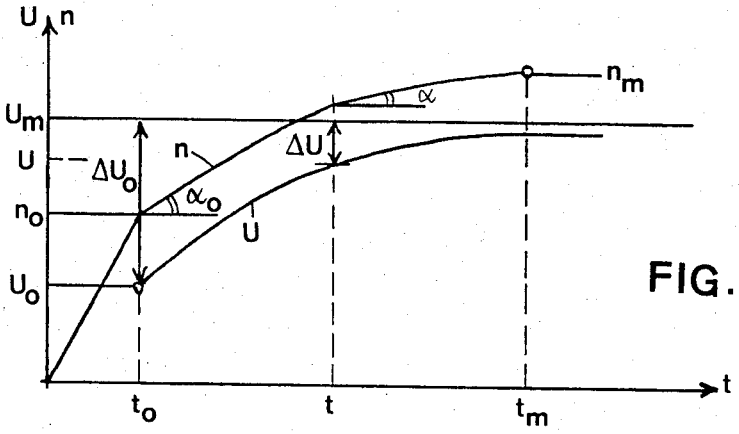
FIG. 2 illustrates a method with continuous acceleration.

In the method illustrated in FIG. 2, the regulating mechanism is constructed and designed such that after the time $t_o$ when the rotation speed $n_o$ is reached, at which the regulating process begins, the interval $\Delta U_o$ of the measured imbalance $U_o$ is formed from the maximum permissible value $U_m$. This interval $\Delta U_o$ is used as standard quantity and the rate of increase in the rotation speed n, expressed by the angle of rise $\alpha_o$, is regulated to a corresponding value. This regulation is continuous; i.e., as a result the rate of increase in the rotation speed n; i.e., the angle $\alpha$ is regulated as a function of the difference $\Delta U$ of the measured imbalance from the maximum value $U_m$ such that the rotation speed n rises all the slower, the more the imbalance U approaches the value $U_m$. It is noted that the imbalance comparative value $U_m$ can be selected dependent on time or dependent on rotation speed.

The requisite conversion can take place by means of known electric circuit arrangements or with a microprocessor. By the continuous re-setting of the rotation rate n as a function of the respective imbalance value, an optimally short start-up time $t_m$ can be reached up to the operation rotation speed $n_m$, whereby exceeding the maximum permissible imbalance $U_m$ can be avoided with certainty.

Figure 3:
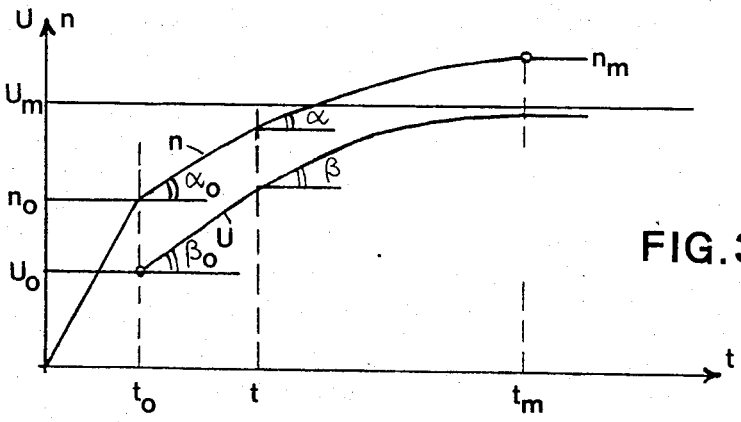
FIG. 3 illustrates a continuous acceleration process with differential regulation.

FIG. 3 shows another continuous acceleration method, in which after reaching the rotation rate $n_o$ after time $t_o$ the measured imbalance $U_o$ is compared with an imbalance value which is immediately adjacent in terms of time and the speed of rise of the imbalance is used as standard amount, expressed by the angle $\beta_o$. Corresponding to this value the rate of increase in the rotation speed n, expressed by the angle $\alpha_o$, is regulated. The regulating process is again continuous, whereby in each case at an angle of rise $\beta$ of the imbalance an angle of rise $\alpha$ of the rotation rate is regulated such that the rise in rotation speed is retarded as long as the imbalance still shows an important rise. Here too within a short period of time in an efficient manner the design rotation speed $n_m$ can be reached without the maximum permissible imbalance $U_m$ being exceeded.

It is important that the acceleration of the device is not only interrupted at a particular imbalance threshold or the rotation speed kept constant for a fixed, pre-set time, but that the interval at constant rotation rate is kept variable and is regulated as a function of the alteration in imbalance with minimal time delay. Thereby the time can be determined in which the imbalance alters by a particular amount, or the time intervals between the measuring points can be largely reduced so that the alteration speed of the imbalance is measured, which is practically equal to a differential regulation. In comparison with former methods with a single threshold value for the imbalance or fixed pauses, an optimally short acceleration time is achieved, while the imbalance remains with certainty below the permissible threshold.

The method according to the invention is particularly advantageous in the application in centrifuging devices which rotate about an horizontal axis, specifically in washing/centrifuging machines of large dimensions; i.e., with diameters in the meter- range, where great imbalance forces may occur, which cannot be avoided by a special loading of the machine, but only by a suitable acceleration process.

We claim:

1. A method for controlling the acceleration to design speed of a centrifuging device subject to variable imbalance, the method comprising the steps of measuring the imbalance as the device is accelerated; limiting speed changes of the device to a positive range of acceleration values including zero; and regulating acceleration of the device within that range solely as a function of the difference between the measured imbalance and a threshold value, whereby the acceleration period is kept short while avoiding excessive imbalance.

2. A method according to claim 1 wherein the threshold value is the maximum permissible imbalance value.

3. A method according to claim 1 wherein the acceleration of the device reduces as does said difference.

4. A method according to claim 1 wherein initial acceleration of the device is carried out independantly of any imbalance up to a predetermined speed, imbalance being subsequently monitored and acceleration being accordingly controlled.

5. A method according to claim 1 wherein imbalance is measured as a function of the deflection of the device during rotation.

6. A method according to claim 1 wherein imbalance is measured as a function of the forces occurring on at least one bearing of the device.

7. A method according to claim 6 wherein said at least one bearing includes an hydrostatic support piston.

8. A method according to claim 1 wherein said device is a centrifuge drum which rotates about a horizontal axis.

9. A method according to claim 1 wherein said device is a centrifuge drum of a washing machine which rotates about a horizontal axis.

* * * * *